US010982539B2

(12) United States Patent
Khan et al.

(10) Patent No.: US 10,982,539 B2
(45) Date of Patent: Apr. 20, 2021

(54) ACQUIRING FORMATION FLUID SAMPLES USING MICRO-FRACTURING

(71) Applicant: Halliburton Energy Services, Inc., Houston, TX (US)

(72) Inventors: Waqar Ahmad Khan, Houston, TX (US); Syed Muhammad Farrukh Hamza, Houston, TX (US); Sandeep Ramakrishna, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 216 days.

(21) Appl. No.: 16/308,857

(22) PCT Filed: Jul. 29, 2016

(86) PCT No.: PCT/US2016/044648

§ 371 (c)(1),
(2) Date: Dec. 11, 2018

(87) PCT Pub. No.: WO2018/022079

PCT Pub. Date: Feb. 1, 2018

(65) Prior Publication Data

US 2019/0153860 A1 May 23, 2019

(51) Int. Cl.
*E21B 49/10* (2006.01)
*E21B 43/267* (2006.01)
(Continued)

(52) U.S. Cl.
CPC ..... *E21B 49/10* (2013.01); *E21B 27/02* (2013.01); *E21B 43/26* (2013.01); *E21B 43/267* (2013.01)

(58) Field of Classification Search
CPC ..... E21B 43/26; E21B 43/267; E21B 49/10
See application file for complete search history.

(56) References Cited

U.S. PATENT DOCUMENTS 3,273,647 A 9/1966 Briggs, Jr. et al.
5,303,775 A * 4/1994 Michaels ..... E21B 49/10 166/264

(Continued)

FOREIGN PATENT DOCUMENTS

WO 2016085451 6/2016

OTHER PUBLICATIONS

Omokaro et al., "Challenges of Wireline Formation Testing and Fluid Sampling in Tight, Low Permeability Gas Reservoirs: Case Study from Saudi Arabia", at ;east as early as Jun. 30, 2015, 13 pages.

(Continued)

*Primary Examiner* — Blake E Michener
(74) *Attorney, Agent, or Firm* — Kilpatrick Townsend & Stockton LLP

(57) ABSTRACT

A formation-tester tool may be positioned downhole in an openhole wellbore. The formation-tester tool may suspend proppant in fracturing fluid located in a chamber of the formation-tester tool. The formation-tester tool may generate a test fracture in an uncased wall of an area of interest of a subterranean formation adjacent to the openhole wellbore and inject the fracturing fluid and the proppant toward the uncased wall and into the test fracture. The formation-tester tool may retrieve a fluid sample from a reservoir within the area of interest of the subterranean formation by creating a drawdown pressure in the test fracture.

20 Claims, 6 Drawing Sheets

(51) Int. Cl.
*E21B 43/26* (2006.01)
*E21B 27/02* (2006.01)

(56) References Cited

U.S. PATENT DOCUMENTS

| | | | |
|---|---|---|---|
| 8,122,956 | B2 | 2/2012 | Shammai et al. |
| 8,230,919 | B2 | 7/2012 | Goodwin et al. |
| 8,397,817 | B2 | 3/2013 | Edwards et al. |
| 2005/0164893 | A1 | 7/2005 | Slabaugh et al. |
| 2009/0250207 | A1 | 10/2009 | May et al. |
| 2012/0043080 | A1 | 2/2012 | Edwards et al. |
| 2013/0315024 | A1 | 11/2013 | Ringgenberg et al. |
| 2015/0167442 | A1 | 6/2015 | Harfoushian |
| 2016/0053160 | A1 | 2/2016 | Nguyen et al. |

OTHER PUBLICATIONS

International Patent Application No. PCT/US2016/044648 , "International Search Report and Written Opinion", dated Apr. 21, 2017, 14 pages.
European Application No. EP16910742.2 , "Extended European Search Report", dated Apr. 26, 2019, 10 pages.
EP Application No. EP16910742.2 , Office Action, dated May 26, 2020, 4 pages.

* cited by examiner

ACQUIRING FORMATION FLUID SAMPLES USING MICRO-FRACTURING

TECHNICAL FIELD

The present disclosure relates generally to micro-fracturing tools and, more particularly (but not exclusively), to a formation-tester system for retrieving formation fluid samples using micro-fracturing techniques.

BACKGROUND

Micro-fracturing, or "microfrac," operations may be used to test a subterranean formation prior to initializing a full-scale hydraulic fracture treatment of the subterranean formation. In some aspects, a microfrac test may include performing very small-scale fracturing operations in an openhole wellbore using a small quantity of fracturing fluid. After a sufficiently long fracture is created in the subterranean formation, the fracturing operations are stopped and properties of the newly created fracture and the surrounding formation are analyzed as the fracture closes.

DETAILED DESCRIPTION

Figure 1:
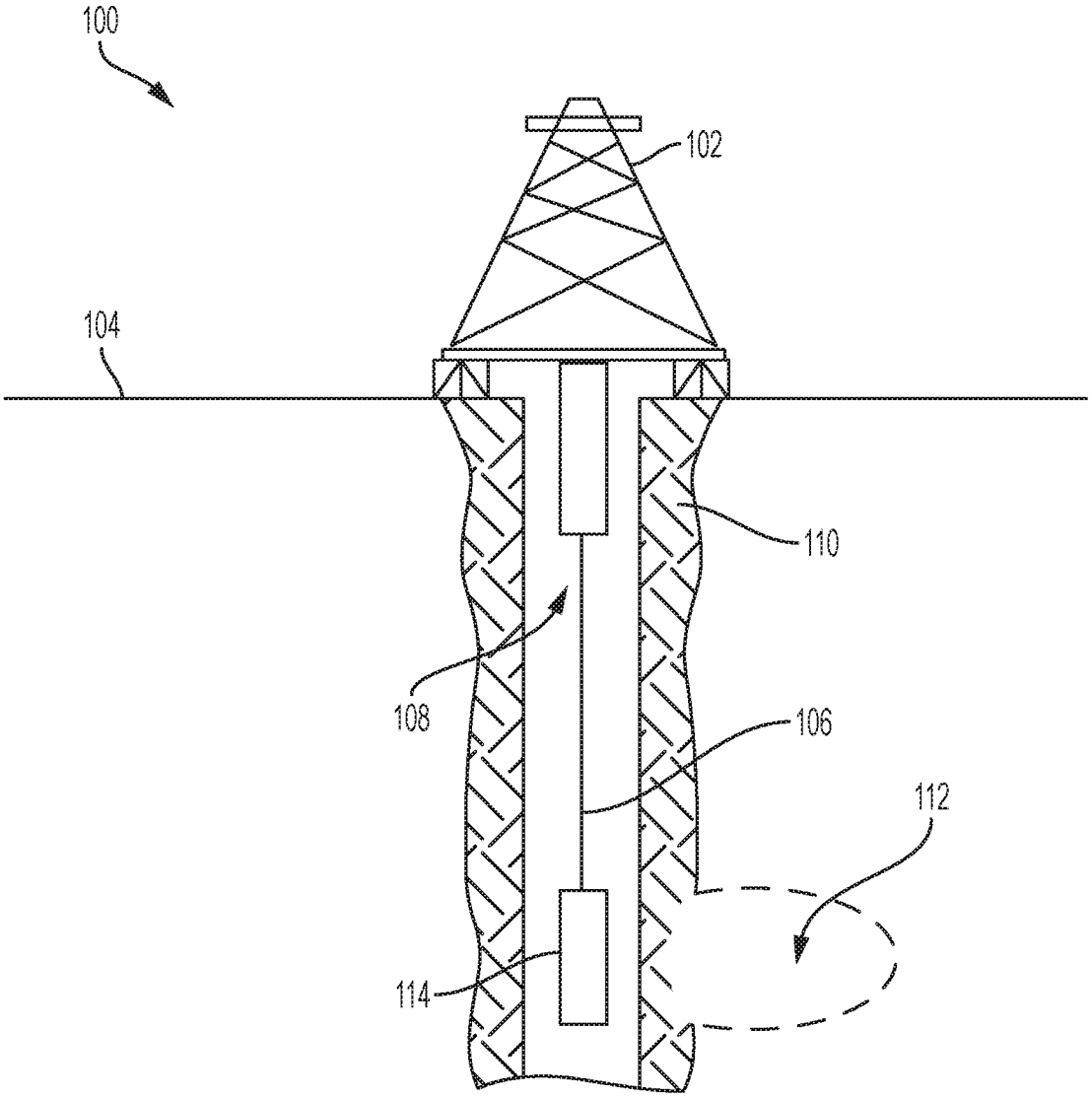
FIG. 1 is a cross-sectional schematic diagram depicting an example of a wellbore environment for a formation-tester tool according to one aspect of the present disclosure.

Certain aspects and examples of the present disclosure relate to collecting a sample of formation fluid from an unconventional subterranean formation using a formation-tester tool. The tool includes a dual-action pumping device that is operable to generate a test fracture in the subterranean formation, inject proppant-laden fracking fluid into the test fracture, and retrieve fracture fluid from the fracture. In some aspects, the proppant-laden fluid may be agitated prior to the pumping device injecting the proppant-laden fluid into the fracture to prevent the proppant from settling in the fluid. For example, the formation-tester tool may be suspended in an openhole, or uncased, wellbore adjacent to the subterranean formation by a wireline. The wireline may raise and lower the formation-tester tool to move the chambers containing the proppant-laden fluid, thereby agitating the proppant-laden fluid. In other aspects, the proppant-laden fluid may be transmutable in response to a triggering event to allow the proppant to remain suspended in the fluid prior to injecting the fluid into the fracture. For example, the proppant-laden fluid may include a shear-rate dependent viscosity and the movement of the formation-tester tool by the wireline may cause the viscosity of the proppant-laden fluid to lower prior to the pumping device injecting the fluid into the test fracture. Subsequent to the micro-fracturing operation, the proppant injected into the test fracture may prevent the test fracture from closing completely, creating a flow path from a reservoir within the subterranean formation to the wellbore. The pumping device may retrieve a sample of fluid from the reservoir by reversing the pump direction or using a second pump to create a drawdown pressure.

A formation-tester tool according to some aspects may allow for a collection of low-mobility fluid samples in tight formations. The low mobility of the wellbore coupled with the low permeability of the subterranean formation adjacent to the wellbore may present challenges for sampling via conventional fracturing operations. In some aspects, the formation-tester tool may generate a small fracture with a limited amount of fluid to allow for a more compact tool that may be more easily navigated downhole. Further, the ability of a pressure pump of the formation-tester tool according to some aspects to create both a pressure to inject fluid from the tool and a drawdown pressure to allow flow-back of a sample fluid into the tool may reduce the size of the tool and allow the smaller or shorter tool to initiate each operation.

The formation-tester tool according to some aspects may be configured to perform the micro-fracturing techniques in an openhole wellbore. The fractures generated by the formation-tester tool may be small to prevent destabilization of an uncased wall of the openhole wellbore. Using the micro-fracturing techniques may allow the formation-tester tool to transport a small amount of fracturing fluid into the wellbore, decreasing the size of the tool. Also, the formation-tester tool according to some aspects may reduce the number of components to perform the operations. A single pumping device of the tool may be configured to generate the fracture, inject proppant-laden fluid to maintain the fracture, and retrieve a sample of formation fluid from the subterranean formation. The sections of the tool may also be modular to allow only those sections necessary to complete the operation to be disposed in the wellbore. Time-savings and cost-savings may be realized as using the formation-tester tool prior to casing the wellbore may provide shorter configuration time for the tool (e.g., not including additional sections for drilling through the casing) and less time completing the operation. Performing the micro-fracturing operations and the sample-retrieval operations prior to completing the wellbore may also result in a safer operation as additional drilling in the wellbore is not required. Also, retrieving fluid samples from the uncased formation may provide advance analysis of reservoir fluid types, fluid mobility, and the location of fluid contacts to plan where in the wellbore, subsequent to completing the wellbore, to focus future fracturing efforts to maximize production of hydrocarbons.

Various aspects of the present disclosure may be implemented in various environments. For example, FIG. 1 is a cross-sectional schematic diagram depicting an example of a wellbore environment 100 for a micro-fracturing and sample retrieval operation according to one aspect of the present disclosure. The wellbore environment 100 includes a derrick 102 positioned at a surface 104 of the earth. The derrick 102 may support components of the wellbore environment 100, including a wireline 106. In some aspects, the wireline 106 may be mechanically connected to the derrick 102 by a tubing string. The derrick 102 may include components to raise and lower, via the wireline 106, wellbore tools attached to the wireline 106 within an openhole, or uncased, wellbore 108 drilled into a subterranean formation 110 of the earth. For purposes of the present disclosure, the wellbore 108 may have a small circumference and include limited mobility for the wireline 106 to navigate tools within the wellbore 108. The subterranean formation 110 may be a tight formation having limited permeability for formation fluids within the subterranean formation 110. For example, the subterranean formation 110 may include a shale formation, or shale play. A reservoir 112 may be included within the subterranean formation 110. In some aspects, the reservoir 112 may represent hydrocarbons, such as natural gases or other formation fluid, trapped within the subterranean formation 110.

A formation-tester tool 114 may be positioned in the wellbore 108 on the wireline 106 to generate a small fracture in the subterranean formation 110 to collect a sample of the formation fluid in the reservoir 112. The fracture may include a fissure or crevice in the subterranean formation 110 that creates a flow path for the formation fluid in the reservoir to flow toward the wellbore 108. In some aspects, the formation-tester tool 114 may include components for generating the fracture and collecting the sample of the formation fluid from the wellbore. In some aspects, the fracture generated by the formation-tester tool may be small enough to maintain the stability of the wellbore 108 without causing unintended fractures or collapse of an uncased wall of the wellbore.

Figure 2:
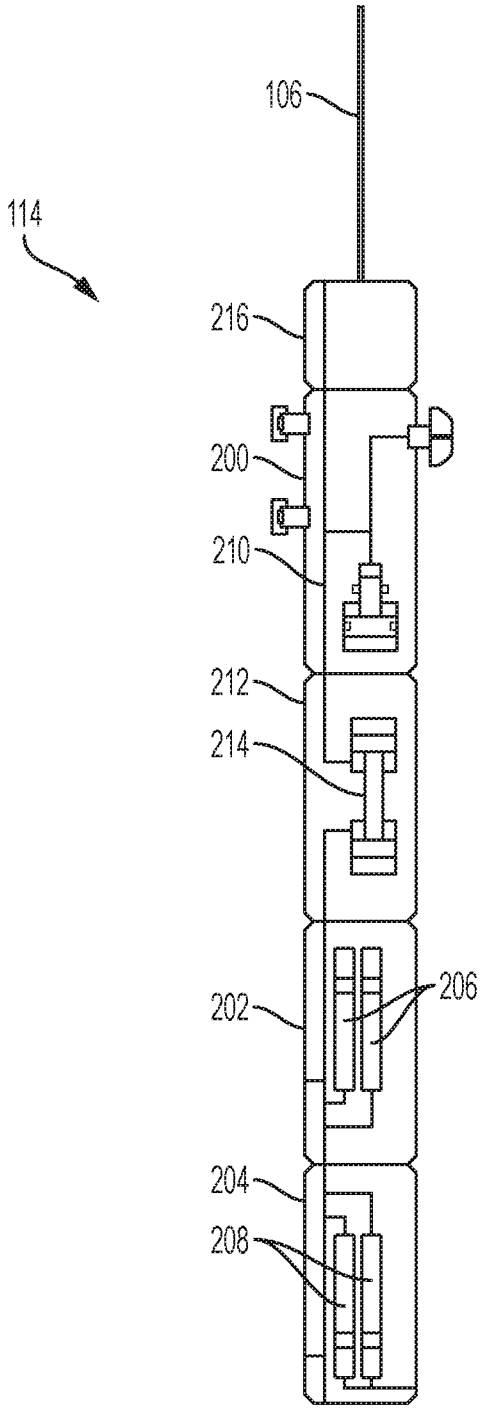
FIG. 2 is a cross-sectional schematic diagram of the formation-tester tool of FIG. 1 according to one aspect of the present disclosure.

FIG. 2 is a cross-sectional schematic diagram of the formation-tester tool 114 according to one aspect of the present disclosure. The formation-tester tool 114 may include one or more sections, or modules, that may be interconnected to generate a test fracture in the subterranean formation 110 of FIG. 1 and to collect a sample of formation fluid from the reservoir 112 within the subterranean formation 110. In some aspects, the sections may be modular or interchangeable to serve the various purposes of a wellbore operation performed in the wellbore 108. For example, the formation-tester tool 114 may be assembled to include only sections necessary to complete an intended operation in the wellbore 108. In FIG. 2, the formation-tester tool 114 includes a pumping section 200, a fracturing fluid section 202, and a sample collection section 204. The fracturing fluid section 202 may include one or more chambers 206 containing fracturing fluid for use by a pumping device within the pumping section 200 to generate a fracture in a subterranean formation. The chambers 206 may also include proppant in the fracturing fluid to prop the fracture open to allow the formation-tester tool 114 to extract formation samples from the subterranean formation through the fracture. In some aspects, the chambers 206 may include a limited amount of fracturing fluid to create a small fracture in the subterranean formation 110 of FIG. 1 and to be pumped into the fracture with proppant. In some aspects, the chambers 206 may support between 1 and 30 liters of fracturing fluid for performing both operations. The sample collection section 204 may include one or more chambers 208 that may be used to store the sample formation fluid collected from the fracture generated by the formation-tester tool 114.

The pumping section 200, the fracturing fluid section 202, and the sample collection section 204 are hydraulically connected by a feedline 210 that extends through each of the sections 200, 202, 204 to transmit an appropriate fluid between the pumping section 200 and the chambers 206, 208. In some aspects, the formation-tester tool 114 may also include a control section 212 including a fluid regulator 214 connected to the feedline 210 and configured to route the fluids to an appropriate section of the formation-tester tool 114. For example, the fluid regulator 214 may route fracturing fluid from the chambers 206 of the fracturing fluid section 202 to the pumping section 200 for generating and maintaining the fracture in the subterranean formation. The fluid regulator 214 may route formation fluid sampled from the fracture to the chambers 208 in the sample collection section 204 for storage and analysis. In some aspects, the fluid regulation device 214 may include one or more pumps or valves operable in conjunction with a pumping device positioned in the pumping section 200 to allow fluid into and out of the formation-tester tool 114. In some aspects, the formation-tester tool 114 may include additional sections, represented in FIG. 2 by section 216. For example, other sections may include a telemetry section that provides electrical and data communication between the modules and an uphole control unit positioned at the surface 104, a power module that converts electricity into hydraulic power. In another example, section 216 may include a second pump for extracting formation fluid from the reservoir 112 of FIG. 1. In an additional example, the section 216 may include a sensor array including one or more sensors for monitoring characteristics of the formation fluid extracted from the reservoir. In some aspects, the wireline 106 may include conductors for carrying power from the surface 104 to the various sections of the formation-tester tool 114. Although the sections 200, 202, 204, 212, 216 of the formation-tester tool 114 are shown in FIG. 1 in a particular order, the sections may be arranged in any order on the formation tester tool without departing from the scope of the present disclosure.

Figure 3:
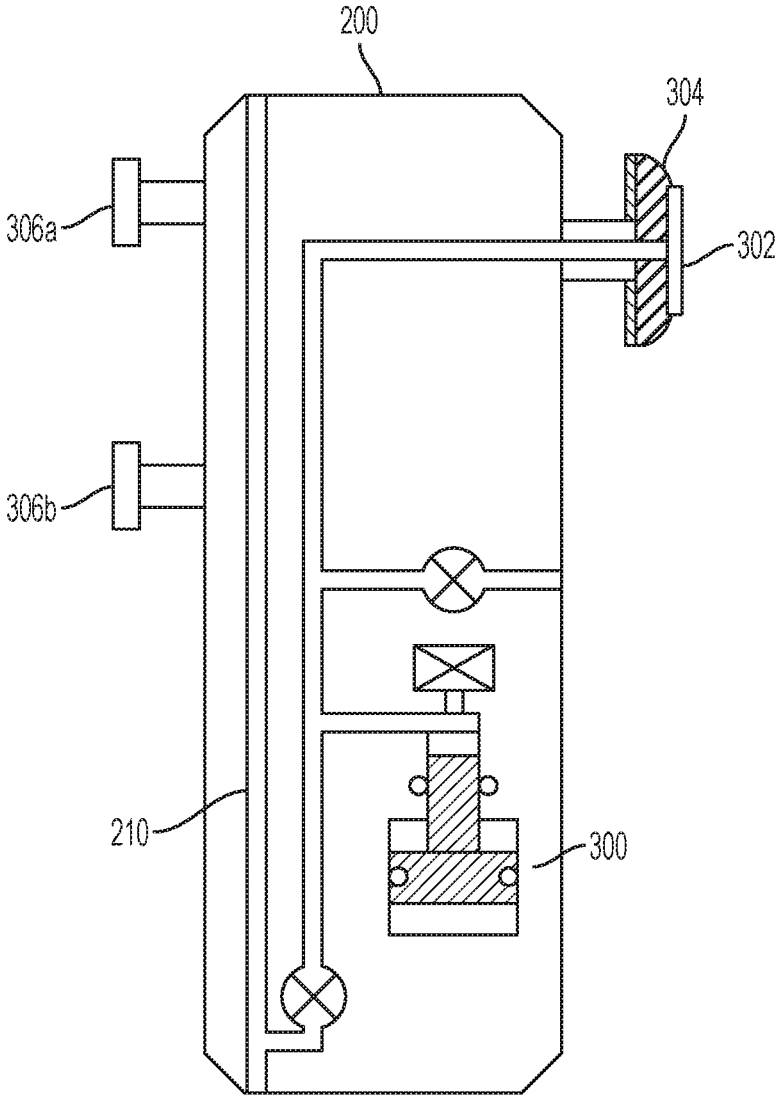
FIG. 3 is a cross-section schematic diagram of a pumping section of the formation-tester tool of FIG. 2 according to one aspect of the present disclosure.

FIG. 3 is a cross-section schematic diagram of the pumping section 200 of the formation-tester tool 114 according to one aspect of the present disclosure. The pumping section 200 includes a pump 300. In some aspects, the pump 300 may include a reciprocating pump. In additional aspects, the pump 300 may be dual-acting, or double acting. As a double-acting pump, the pump 300 may be able to pump fracturing fluid from the formation-tester tool 114 via a nozzle 302 in the pumping section 200, as well as create a drawdown pressure to pump formation fluid into the formation-tester tool 114 through the nozzle 302. In some aspects, the pump 300 may include pumping components positioned in the fluid regulator 214 of the control section 212 of FIG. 2. In some aspects, the pump 300 may include one or more dual-check valves to allow for fluid flow in multiple directions without allowing fluid to enter an inappropriate chamber (e.g., formation fluid in the chambers 206 of FIG. 2, fracturing fluid in the chambers 208 of FIG. 2).

In some aspects, the nozzle 302 may represent one or more openings or channels in the pumping section 200 that may serve as an inlet or outlet to fluids. The nozzle 302 may be hydraulically connected to the feedline 210 to allow the formation fluid to fluidly communicate with fluid in the wellbore 108 and subterranean formation 110 of FIG. 1. In some aspects, the nozzle 302 may be surrounded by a sealing pad 304. The sealing pad 304 may be positioned around the nozzle 302 to contact the subterranean formation 110 of FIG. 1 during the micro-fracturing operation or during the retrieval of a sample of formation fluid from the subterranean formation 110. For example, the sealing pad 304 may create suction to isolate an uncased wall of the subterranean formation 110 of FIG. 1. In some aspects, the sealing pad 304 may be supported by a hydraulic piston to create the suction. On a side of the pumping section 200 opposite the nozzle 302 include setting rams **306*a*, 306*b* extending from the pumping section 200 to provide stability for the formation-tester tool 114 during operation of the pump 300. In some aspects, the setting rams 306***a*, 306*b* may be lateral moveable by actuators inside the formation-tester tool 114 to extend and retract the setting rams 306*a*, 306*b*. In other aspects, the setting rams 306*a*, 306*b* may be optional or removable to reduce a circumference of the formation-tester tool 114 and allow for mobility in a narrow wellbore.

Figure 4:
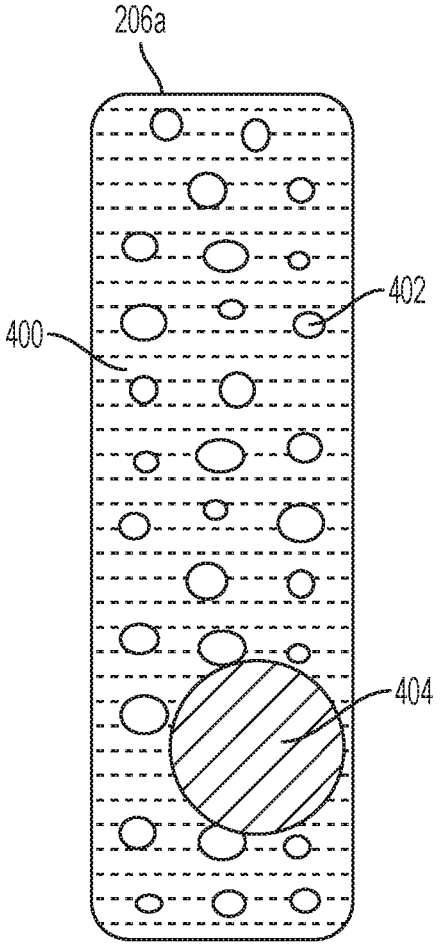
FIG. 4 is a cross-sectional schematic diagram of a fracturing fluid chamber of a formation-tester tool according to aspects of the present disclosure.

FIG. 4 is a cross-sectional schematic diagram of a fracturing fluid chamber 206*a* of a formation-tester tool according to aspects of the present disclosure. In some aspects, the chamber 206*a* may represent one or more of the chambers 206 within the fracturing fluid section 202 of the formation-tester tool 114 of FIG. 2. The chamber 206*a* includes fracturing fluid 400. In some aspects, the fracturing fluid 400 may include any suitable fluid used for conventional fracturing operations in a wellbore to create a fracture in a subterranean formation adjacent to the wellbore. In some aspects, the fracturing fluid 400 may be a Newtonian fluid. In other aspects, the fracturing fluid 400 may be a non-Newtonian fluid. In some aspects, the fracturing fluid 400 may include water that is treated with one or more chemical additives, including, but not limited to friction-reducing additives, biocides, and oxygen scavengers. The fracturing fluid 400 may also be laden with proppant 402. The proppant 402 may include a granular material having rigid properties for keeping the fracture open when injected into a fracture of a subterranean formation 110. In some aspects, the proppant may include, but is not limited to, silica sand, sintered bauxite, ceramic beads. The proppant 402 may suspended in the fracturing fluid 400 prior to the fracturing fluid 400 being injected into a fracture of a subterranean formation. Suspending the proppant 402 in the fracturing fluid 400 may allow for enhanced permeability of the subterranean formation as the proppant 402 may be more evenly dispersed within the fracture. In some aspects, the proppant 402 may be sized to enhance the permeability of the subterranean formation. For example, in some aspects small proppant (e.g., a standard mesh size between 10 and 50) may be used. In another example, a small proppant may not provide sufficient permeability of a tight formation, such as a shale formation, to retrieve a sample of the formation fluid, and the proppant may include a size of 100-mesh or higher. In one example, the proppant may include a standard mesh size of 325-mesh to achieve sufficient permeability of the subterranean formation to retrieve the formation fluid. In some aspects, the mesh size of the proppant 402 may be dependent on the viscosity of the fracturing fluid 400 or on the amount of pumping time during the micro-fracturing operations.

In some aspects, mechanical methods may be employed to allow the proppant 402 to remain suspended in the fracturing fluid 400. For example, the chamber 206*a* may optionally include an agitation ball 404 as shown in FIG. 4. In some aspects, the agitation ball 404 may include a rigid material, such as metal, to agitate the fracturing fluid 400 in the chamber 206*a* during movement of the formation-tester tool 114. For example, the agitation ball 404 may be mobile within the chamber 206*a* to mix or stir the fracturing fluid 400 and the proppant 402 to prevent the proppant 402 from settling in the fracturing fluid 400 at the bottom of the chamber 206*a*.

In additional and alternative aspects, chemical methods may be employed to allow the proppant 402 to remain suspended in the fracturing fluid 400. For example, in some aspects, the fracturing fluid 400 may be a non-Newtonian fluid having a shear-dependent viscosity. The fracturing fluid 400 may have a high viscosity to keep the proppant 402 suspended in the fracturing fluid 400. The viscosity may be lowered in response to movement of the formation-tester tool 114 at a predetermined level that causes the viscosity to lower sufficiently for injecting the fracturing fluid 400 from the chamber 206*a* into the wellbore 108 and the fracture in the subterranean formation 110 of FIG. 1. In another example, the fracturing fluid 400 may include a gelling agent that causes the fracturing fluid 400 to have a viscosity high enough to suspend the proppant 402 in the fracturing fluid 400. In some aspects, an additional fluid, e.g., a "breaker" fluid, may be injected into the chamber 206*a* to transform the fracturing fluid from a gel state into more of a liquid state having a lower viscosity for injection. In some aspects, the breaker fluid may be housed in one or more additional chambers in another section of the formation-tester tool 114 and may be injected into the chamber 206*a* via the feedline 210 of the formation-tester tool 114 of FIG. 2.

Figure 5:
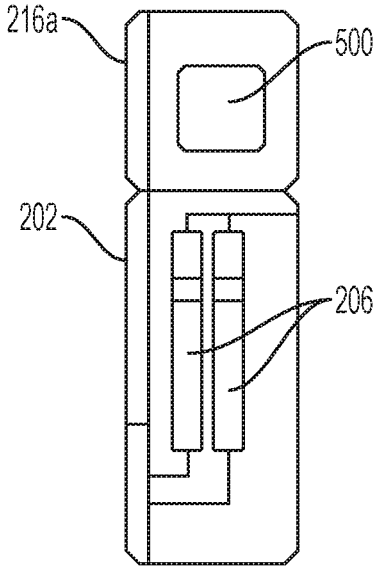
FIG. 5 is a cross-sectional schematic diagram of an acoustic resonance section of the formation-tester tool of FIG. 2 according to some aspects of the present disclosure.

In further aspects, acoustic methods may be employed to allow the proppant 402 to remain suspended in the fracturing fluid 400. For example, FIG. 5 is a cross-sectional schematic diagram of an acoustic resonance section 216*a* of the formation-tester tool 114 according to some aspects of the present disclosure. The acoustic resonance section 216*a* may represent one of the other sections of the formation-tester tool 114 represented by section 216 of FIG. 2. Although the acoustic resonance section 216*a* is shown as positioned proximate to the fracturing fluid section 202 of the formation-tester tool 114, the acoustic resonance section 216*a* may be positioned anywhere in the formation-tester tool 114. The acoustic resonance section 216*a* includes an acoustic transmitter 500. The acoustic transmitter 500 may be configured to emit one or more acoustic waves at a frequency to cause the fracturing fluid section 202 or the chambers 206*a* within the section to resonate. The resonation caused by the acoustic waves generated by the acoustic transmitter may agitate the fracturing fluid 400 of FIG. 4 to keep the proppant 402 within the fracturing fluid suspended. In some aspects, the acoustic transmitter 500 may be actuatable via a signal from a control unit positioned at the surface 104 of the wellbore 108 of FIG. 1.

Figure 6:
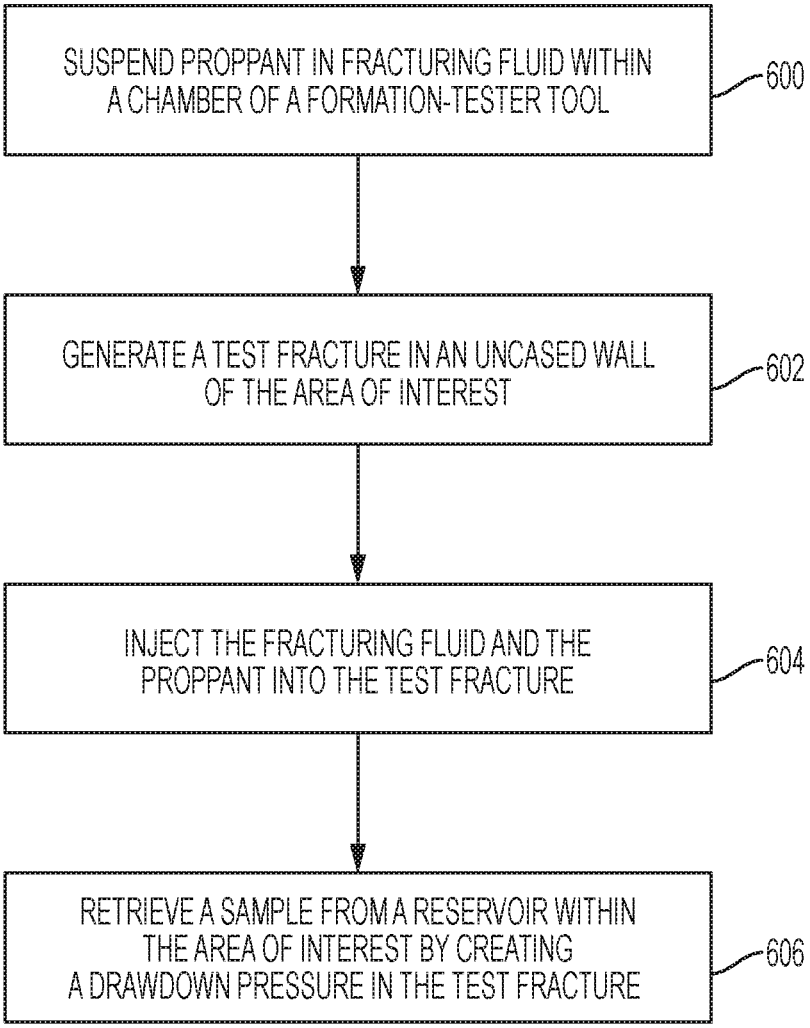
FIG. 6 is a flow chart of a process for retrieving a formation fluid sample using a formation-tester tool according to one aspect of the present disclosure.

FIG. 6 is a flow chart of a process for retrieving a formation sample using a formation-tester tool according to one aspect of the present disclosure. The process may be described with respect to the formation-tester tool 114 of FIGS. 1 and 2, the pumping section 200 of FIG. 3, and the fracturing fluid section of FIG. 4, unless otherwise indicated, although other implementations are possible without departing from the scope of the present disclosure.

In block 600, the proppant 402 within the fracturing fluid 400 of the chamber 206*a* in the fracturing fluid section 202 of the formation-tester tool 114 may be suspended in the fracturing fluid 400. In some aspects, the proppant 402 may be suspended in the chamber 206*a* by the chamber 206*a* of the formation-tester tool 114 moving to agitate the fracturing fluid 400. The agitation may cause the proppant 402 to move within the fracturing fluid 400 and not settle at the bottom of the chamber 206*a*. For example, agitating the fracturing fluid 400 may suspend the proppant 402 in the fracturing fluid 400 when the fracturing fluid 400 is a Newtonian fluid having a low viscosity that allows the proppant 402 to settle over time in the chamber absent the agitation. In one aspect, the fracturing fluid 400 may be agitated by the chamber 206*a* moving in response to an intentional movement of the formation-tester tool 114 by the wireline 106 or other mechanism lowering the formation-tester tool 114 into the wellbore 108. For example, the wireline 106 may rapidly raise and lower the formation-tester tool 114 one or more times to cause the chamber 206*a* to move. The chamber movement may cause the fracturing fluid 400 to move and prevent the proppant 402 within the fracturing fluid 400 from settling at the bottom of the chamber 206*a*. For example, the chamber 206*a* of the formation-tester tool 114 may move in an uphole direction at a rate of 50 feet per minute and then immediately move in an opposing downhole direction at a rate of 100 feet per minute in response to raising or lowering the wireline 106. The interval may be repeated at the same or different rates. For example, subsequent to lowering the formation-tester tool 114 at a rate of 100 feet per minute, the wireline 106 may raise the formation-tester tool 114 again to move the chamber 206*a* at a rate of 30 feet per minute.

In another aspect, the agitation ball 404 may be positioned within the chamber 206*a* to enhance the agitation of the fracturing fluid 400 during movement of the formation-tester tool 114 by the wireline 106. For example, the movement of the formation-tester tool 114 may cause the agitation ball 404 to move around within the fracturing fluid 400. The movement of the agitation ball 404 may create a stirring or mixing effect on the fracturing fluid 400 to prevent the proppant 402 within the fracturing fluid 400 from settling at the bottom of the chamber 206*a*. In a further aspect, the acoustic transmitter 500 of FIG. 5 may generate acoustic waves at a predetermined frequency to cause the chamber 206*a* to vibrate. The vibration of the chamber 206*a* in response to the acoustic waves may agitate the fracturing fluid 400 to keep the proppant 402 suspended in the fracturing fluid 400.

In additional and alternative aspects, the fracturing fluid 400 may include a non-Newtonian fluid and the proppant 402 may be suspended in the fluid by maintaining the fracturing fluid 400 in a highly viscous state for at least a portion of the operation of the formation-tester tool 114. In one aspect, the fracturing fluid 400 may include a gelling agent that causes the fracturing fluid 400 to have a high viscosity to suspend the proppant 402 in the fracturing fluid 400. The viscosity of the fracturing fluid 400 may prevent the proppant 402 from settling in fracturing fluid for an extended amount of time. Prior to extracting the fracturing fluid 400 and the proppant 402 from the chamber 206*a* for injecting into a fracture in the subterranean formation 110, a breaking fluid may be added to the fracturing fluid 400 to lower the viscosity of the fracturing fluid 400. The fracturing fluid 400 and the proppant 402 may remain in a suspended state in the chamber 206*a* without settling to the bottom of the chamber 206*a* by the pump 300 extracting the fracturing fluid 400 and the proppant 402 before the proppant 402 settles in the chamber 206*a*. In another aspect, the fracturing fluid 400 may have a shear-dependent viscosity. The shear-dependent viscosity of the fracturing fluid 400 in a normal state of the fracturing fluid 400 may be high enough to keep the proppant 402 suspended in the fracturing fluid 400 for an extended period of time. Prior to extracting the fracturing fluid 400 and the proppant 402 from the chamber 206*a*, an intentional motion may be applied to the formation-tester tool 114 (e.g., the intentional motion used for agitating the fracturing fluid 400) to cause the formation-tester tool 114 and chamber 206*a* to move. The movement may create a shear stress in the fracturing fluid 400 present in the chamber 106*a* to lower the fluid viscosity.

In block 602, a test fracture is generated in an uncased wall of the subterranean formation 110 at the area of interest. In some aspects, the pump 300 may inject pressurized fracturing fluid at the uncased wall to cause the subterranean formation to fracture. In some aspects, the fracturing fluid 400 used to fracture the uncased wall may include the proppant 402 and be extracted from the chamber 206*a*. in other aspects, the formation-tester tool 114 may include additional chambers including fracturing fluid 400 without proppant laden in the fluid. In some aspects, the pump 300 may inject approximately 30 liters of the fracturing fluid 400 toward the uncased wall to fracture the subterranean formation 110. The fracture generated by the pump 300 may be a micro-fracture or mini-fracture corresponding to the size of fractures generated in micro-fracturing or mini-fracturing operations. For example, the fracture may be sized to maintain the stability of the uncased wall of the wellbore 108 (e.g., preventing the wall from destabilizing by collapsing or generating unintended fractures). Similarly, the pressure generated by the pump 300 during the micro-fracture operation may be lowered to prevent the wellbore 108 from destabilizing by pumping the fracturing fluid 400 at a slower rate to generate the fracture.

In block 604, the pump 300 injects the fracturing fluid 400 with the proppant 402 into the fracture generated in block 602. In some aspects, the pump 300 may inject the fracturing fluid 400 and the proppant 402 into the wellbore at the same rate as the pumping device injected the fracturing fluid 400 to generate the fracture. In other aspects, the fracturing fluid 400 and the proppant 402 may be injected into the fracture at a slower rate than the injection rate used to generate the fracture. For example, the fracturing fluid 400 and the proppant 402 may be generated at a rate to control the growth of the fracture and to prevent destabilization of the wellbore 108. In some aspects, the pump 300 may pump the fracturing fluid 400 and the proppant 402 into the fracture at a rate of between 0.001 and 0.1 barrels per minute (e.g., 0.02 barrels per minute) to achieve a fracture of a sufficient size to retrieve a sample of formation fluid from the subterranean formation 110. In additional aspects, generating the test fracture and injecting the fracturing fluid 400 and proppant into the test fracture may include a continuous pumping operation by the pump 300.

In block 606, the pump 300 retrieves a sample of formation fluid from the reservoir 112 in the subterranean formation 110 by creating a drawdown pressure in the fracture. In some aspects, the drawdown pressure may include a differential pressure to drive formation fluid from the reservoir 112 and into the wellbore 108 for collection by the formation-tester tool 114. In some aspects, the drawdown pressure may be created by reversing the operation of the pump 300 to cause the pump 300 to exert a suction pressure into the formation-tester tool 114 in an opposite direction of the pressure used to generate the fracture and inject the fracturing fluid and proppant. In other aspects, the drawdown pressure may be created by a second pump included in the formation-tester tool 114. In some aspects, the drawdown pressure may extract the fracturing fluid remaining in the fracture and formation fluid from the reservoir 112. The formation fluid from the reservoir 112 may be collected by the formation-tester tool 114 through the nozzle 302 and stored in the chambers 208 in the sample collection section 204 of the formation-tester tool 114. In some aspects, the formation fluid initially pumped from the reservoir 112 may contain a significant quantity of fracturing fluid. This formation fluid may be discarded into the borehole until a cleaner sample is obtained. In additional aspects, the process of obtaining a minimally contaminated sample may be monitored using one or more sensors to monitor the density, capacitance, resistivity, optical transmittance, or color of the formation fluid.

In some aspects, systems and methods may be provided according to one or more, or a combination of any portion, of the following examples:

Example 1

A method may include suspending, by a formation-tester tool positioned downhole in an openhole wellbore, proppant in fracturing fluid located in a chamber of the formation-tester tool. The method may also include generating, by the formation-tester tool, a test fracture in an uncased wall of an area of interest of a subterranean formation adjacent to the openhole wellbore. The method may also include injecting, by the formation-tester tool, the fracturing fluid and the proppant toward the uncased wall and into the test fracture. The method may also include retrieving, by the formation-tester tool, a fluid sample from a reservoir within the area of interest of the subterranean formation by creating a drawdown pressure in the test fracture.

Example 2

The method of example 1 may feature the formation-tester tool positioned downhole in the openhole wellbore on a wireline. The method may also feature suspending the proppant in the fracturing fluid located in the chamber of the formation-tester tool to include, prior to generating the test fracture, agitating the fracturing fluid by the chamber of the formation-tester tool moving, for at least one interval, in an uphole direction and in an opposing direction in succession.

Example 3

The method of examples 1-2 may feature the formation-tester tool moving in the uphole direction at a first rate and moves in the opposing direction at a second rate. The method may also feature the first rate being a different rate than the second rate.

Example 4

The method of examples 1-3 may feature the fracturing fluid located in the chamber of the formation-tester tool including a non-Newtonian fluid. The method may also feature moving, by the formation-tester tool, applying a shear stress onto the fracturing fluid located in the chamber to lower a viscosity of the fracturing fluid.

Example 5

The method of examples 1-4 may feature moving, by the formation-tester tool, causing an agitation ball positioned in the chamber to move within the fracturing fluid in the chamber.

Example 6

The method of examples 1-5 may feature suspending the proppant in the fracturing fluid located in the chamber of the formation-tester tool including, prior to generating the test fracture, transmitting, by an acoustic resonance section of the formation-tester tool, an acoustic wave to cause the chamber of the formation-tester tool to vibrate and the fracturing fluid to move.

Example 7

The method of examples 1-6 may feature the fracturing fluid including a gelling agent. The method may also feature suspending the proppant in the fracturing fluid located in the chamber of the formation-tester tool including injecting a breaker fluid into the chamber to decrease a viscosity of the fracturing fluid prior to injecting the fracturing fluid into the test fracture. The method may also feature suspending the proppant in the fracturing fluid located in the chamber of the formation-tester tool including extracting the fracturing fluid and the proppant from the chamber prior to the proppant settling in the chamber.

Example 8

The method of examples 1-7 may feature injecting the fracturing fluid and the proppant toward the uncased wall and into the test fracture including injecting the fracturing fluid into the test fracture at a rate of between 0.001 barrels per minute and 0.1 barrels per minute.

Example 9

The method of examples 1-8 may feature creating the drawdown pressure in the test fracture including reversing a pumping direction of the fracturing fluid.

Example 10

The method of examples 1-9 may feature the subterranean formation being a shale formation.

Example 11

A formation-tester tool may include one or more chambers positioned in a first section of the formation-tester tool and sized to include fracturing fluid and proppant. The formation-tester tool may also include a nozzle positionable proximate to an uncased wall of an openhole wellbore adjacent to an area of interest of a subterranean formation including a reservoir. The formation-tester tool may also include a pump positioned in a second section of the formation-tester tool. The pump may be in hydraulic communication with the one or more chambers by a feedline extending between the first section and the second section to inject the fracturing fluid and the proppant from the one or more chambers into a test fracture of the area of interest of the subterranean formation. The test fracture may be sized to prevent the openhole wellbore from destabilizing. The formation-tester tool may also feature the pump also being in fluid communication with the nozzle via the feedline to retrieve a fluid sample from the reservoir within the area of interest by creating a drawdown pressure in the test fracture through the nozzle and storing the fluid sample in one or more additional chambers positioned in a third section of the formation-tester tool.

Example 12

The formation-tester tool of example 11 may also include an agitation ball positionable in at least one chamber of the one or more chambers to agitate the fracturing fluid and the proppant.

Example 13

The formation-tester tool of examples 11-12 may feature the fracturing fluid including a gelling agent causing the fracturing fluid to have a viscosity to suspend the proppant in the fracturing fluid.

Example 14

The formation-tester tool of examples 11-13 may also include an acoustic resonance device having a transmitter to transmit acoustic waves at a frequency that causes the one or more chambers to vibrate and agitate the fracturing fluid.

Example 15

The formation-tester tool of examples 11-14 may feature the fracturing fluid including a shear-rate-dependent viscosity. The formation-tester tool may be positioned on a wireline and operable to apply a shear stress onto the fracturing fluid to lower a viscosity of the fracturing fluid in response to a movement of the wireline.

Example 16

The formation-tester tool of examples 11-15 may feature the pump being a double-acting, reciprocating pump operable to exert a first pressure in a first direction toward the uncased wall and a second pressure in an opposite direction of the first direction.

Example 17

The formation-tester tool of examples 11-16 may feature the proppant including a standard mesh size between 100 and 325 mesh.

Example 18

A method may include positioning a formation-tester tool in an openhole wellbore proximate to an area of interest of a shale formation adjacent to the openhole wellbore. The method may also include moving the formation-tester tool in a first direction and in a second direction opposite the first direction in succession to cause the formation-tester tool to agitate proppant-laden fracturing fluid located in a first chamber of the formation-tester tool prior to the proppant-laden fracturing fluid being injected into a fracture in the shale formation. The method may also feature retrieving, subsequent to the formation-tester tool injecting the proppant-laden fracturing fluid into the fracture, the formation-tester tool from the openhole wellbore with a sample of formation fluid located in a second chamber of the formation-tester tool, the sample being extracted by the formation-tester tool from the shale formation through the fracture.

Example 19

The method of example 18 may feature the first direction including one of an uphole direction toward a surface of the openhole wellbore or a downhole direction away from the surface of the openhole wellbore. The method may also feature the proppant-laden fluid including an agitation ball positioned in the first chamber. The method may also feature moving the formation-tester tool in the first direction and in the second direction in succession including causing the formation-tester tool to agitate the proppant-laden fluid by causing the agitation ball to move within the first chamber.

Example 20

The method of examples 18-19 may feature the proppant-laden fluid including a shear-dependent viscosity. The method may also feature the formation-tester tool in the first direction and in the second direction in succession including causing a shear stress to be applied onto the proppant-laden fracturing fluid in the first chamber to lower a viscosity of the proppant-laden fracturing fluid.

The foregoing description of the examples, including illustrated examples, has been presented only for the purpose of illustration and description and is not intended to be exhaustive or to limit the subject matter to the precise forms disclosed. Numerous modifications, adaptations, uses, and installations thereof can be apparent to those skilled in the art without departing from the scope of this disclosure. The illustrative examples described above are given to introduce the reader to the general subject matter discussed here and are not intended to limit the scope of the disclosed concepts.

What is claimed is:

1. A method, comprising:

suspending, by a formation-tester tool positioned downhole in an openhole wellbore, proppant in fracturing fluid located in a chamber of the formation-tester tool, wherein suspending the proppant includes moving an agitation ball positioned within the chamber within the fracturing fluid;

generating, by the formation-tester tool, a test fracture in an uncased wall of an area of interest of a subterranean formation adjacent to the openhole wellbore;

injecting, by the formation-tester tool, the fracturing fluid and the proppant toward the uncased wall and into the test fracture; and retrieving, by the formation-tester tool, a fluid sample from a reservoir within the area of interest of the subterranean formation by creating a drawdown pressure in the test fracture.

2. The method of claim 1, wherein the formation-tester tool is positioned downhole in the openhole wellbore on a wireline, wherein suspending the proppant in the fracturing fluid located in the chamber of the formation-tester tool further includes, prior to generating the test fracture, agitating the fracturing fluid by moving the chamber of the formation-tester tool, for at least one interval, in an uphole direction and in an opposing direction in succession.

3. The method of claim 2, wherein the formation-tester tool moves in the uphole direction at a first rate and moves in the opposing direction at a second rate, wherein the first rate is a different rate than the second rate.

4. The method of claim 2, wherein the fracturing fluid located in the chamber of the formation-tester tool includes a non-Newtonian fluid, wherein moving, by the formation-tester tool, applies a shear stress onto the fracturing fluid located in the chamber to lower a viscosity of the fracturing fluid.

5. The method of claim 1, wherein suspending the proppant in the fracturing fluid located in the chamber of the formation-tester tool includes, prior to generating the test fracture, transmitting, by an acoustic resonance section of the formation-tester tool, an acoustic wave to cause the chamber of the formation-tester tool to vibrate and the fracturing fluid to move.

6. The method of claim 1, wherein the fracturing fluid includes a gelling agent, wherein suspending the proppant in the fracturing fluid located in the chamber of the formation-tester tool includes:

injecting a breaker fluid into the chamber to decrease a viscosity of the fracturing fluid prior to injecting the fracturing fluid into the test fracture; and extracting the fracturing fluid and the proppant from the chamber prior to the proppant settling in the chamber.

7. The method of claim 1, wherein injecting the fracturing fluid and the proppant toward the uncased wall and into the test fracture includes injecting the fracturing fluid into the test fracture at a rate of between 0.001 barrels per minute and 0.1 barrels per minute.

8. The method of claim 1, wherein creating the drawdown pressure in the test fracture includes reversing a pumping direction of the fracturing fluid.

9. The method of claim 1, wherein the subterranean formation is a shale formation.

10. A formation-tester tool, comprising:

one or more chambers positioned in a first section of the formation-tester tool and sized to include fracturing fluid and proppant;

a nozzle positionable proximate to an uncased wall of an openhole wellbore adjacent to an area of interest of a subterranean formation including a reservoir;

an acoustic resonance device having a transmitter to transmit acoustic waves at a frequency that causes the one or more chambers to vibrate and agitate the fracturing fluid; and a pump positioned in a second section of the formation-tester tool, the pump being in hydraulic communication with the one or more chambers by a feedline extending between the first section and the second section to inject the fracturing fluid and the proppant from the one or more chambers into a test fracture of the area of interest of the subterranean formation, the test fracture being sized to prevent the openhole wellbore from destabilizing, wherein the pump is further in fluid communication with the nozzle via the feedline to retrieve a fluid sample from the reservoir within the area of interest by creating a drawdown pressure in the test fracture through the nozzle and storing the fluid sample in one or more additional chambers positioned in a third section of the formation-tester tool.

11. The formation-tester tool of claim 10, further comprising an agitation ball positionable in at least one chamber of the one or more chambers to agitate the fracturing fluid and the proppant.

12. The formation-tester tool of claim 10, further comprising the fracturing fluid in the one or more chambers, wherein the fracturing fluid includes a gelling agent causing the fracturing fluid to have a viscosity to suspend the proppant in the fracturing fluid.

13. The formation-tester tool of claim 10, further comprising the fracturing fluid in the one or more chambers, wherein the fracturing fluid includes a shear-rate-dependent viscosity, wherein the formation-tester tool is positioned on a wireline and operable to apply a shear stress onto the fracturing fluid to lower a viscosity of the fracturing fluid in response to a movement of the wireline.

14. The formation-tester tool of claim 10, wherein the pump is a double-acting, reciprocating pump operable to exert a first pressure in a first direction toward the uncased wall and a second pressure in an opposite direction of the first direction.

15. The formation-tester tool of claim 10, further comprising the proppant in the one or more chambers, wherein the proppant includes a standard mesh size between 100 and 325 mesh.

16. A method, comprising:

positioning a formation-tester tool in an openhole wellbore proximate to an area of interest of a subterranean formation adjacent to the openhole wellbore;

moving the formation-tester tool in a first direction and in a second direction opposite the first direction in succession to cause the formation-tester tool to agitate proppant-laden fracturing fluid located in a first chamber of the formation-tester tool, prior to the proppant-laden fracturing fluid being injected into a fracture in the subterranean formation;

injecting the proppant-laden fracturing fluid into the fracture of the subterranean formation; and retrieving, subsequent to the formation-tester tool injecting the proppant-laden fracturing fluid into the fracture, the formation-tester tool from the openhole wellbore with a sample of formation fluid located in a second chamber of the formation-tester tool, the sample being extracted by the formation-tester tool from the subterranean formation through the fracture.

17. The method of claim 16, wherein the first direction includes one of an uphole direction toward a surface of the openhole wellbore or a downhole direction away from the surface of the openhole wellbore, wherein the proppant-laden fracturing fluid includes an agitation ball positioned in the first chamber, wherein moving the formation-tester tool in the first direction and in the second direction in succession includes causing the formation-tester tool to agitate the proppant-laden fracturing fluid by causing the agitation ball to move within the first chamber.

18. The method of claim 16, wherein the proppant-laden fracturing fluid includes a shear-dependent viscosity, wherein moving the formation-tester tool in the first direction and in the second direction in succession includes causing a shear stress to be applied onto the proppant-laden fracturing fluid in the first chamber to lower a viscosity of the proppant-laden fracturing fluid.

19. The method of claim 16, further comprising transmitting, by the formation-tester tool, an acoustic wave to cause the first chamber of the formation-tester tool to vibrate and thereby agitate the proppant-laden fracturing fluid.

20. The method of claim 16, further comprising moving the formation-tester tool in the first direction at a first rate and in the second direction at a second rate, wherein the first rate is a different rate than the second rate.

* * * * *